United States Patent [19]

Swanson et al.

[11] Patent Number: 4,484,634

[45] Date of Patent: Nov. 27, 1984

[54] FLEXIBLE FIRE PROTECTION SYSTEM

[75] Inventors: Kenneth R. Swanson, Lawrence; Dean E. Wanders, Eudora, both of Kans.

[73] Assignee: Aeroquip Corporation, Jackson, Mich.

[21] Appl. No.: 456,610

[22] Filed: Jan. 10, 1983

[51] Int. Cl.[3] ..... A62C 25/00

[52] U.S. Cl. ..... 169/52; 169/54; 169/16; 239/209

[58] Field of Search ..... 169/51, 54, 37, 16, 169/52; 239/209

[56] References Cited

U.S. PATENT DOCUMENTS 1,826,072 10/1931 Hamilton ..... 169/37 X
3,299,901 1/1967 Axe et al. ..... 239/209 X
3,539,108 11/1970 Lillibridge et al. ..... 169/16 X
3,720,268 3/1973 Seiz ..... 169/16 X

FOREIGN PATENT DOCUMENTS 2010273 10/1971 Fed. Rep. of Germany ..... 169/16

*Primary Examiner*—John J. Love
*Assistant Examiner*—Mary F. McCarthy
*Attorney, Agent, or Firm*—Beaman & Beaman

[57] ABSTRACT

A flexible rigid conduit system particularly suitable for fire protection sprinkler installations usable with movable storage racks wherein a plurality of rigid conduits are interconnected by self-aligning rotary joints permitting pressurized water to be supplied to the storage rack regardless of its location. The conduit system is supported remotely of its fixed portions by a track and carriage arrangement providing support for the conduits and permitting unhindered movement thereof.

5 Claims, 5 Drawing Figures

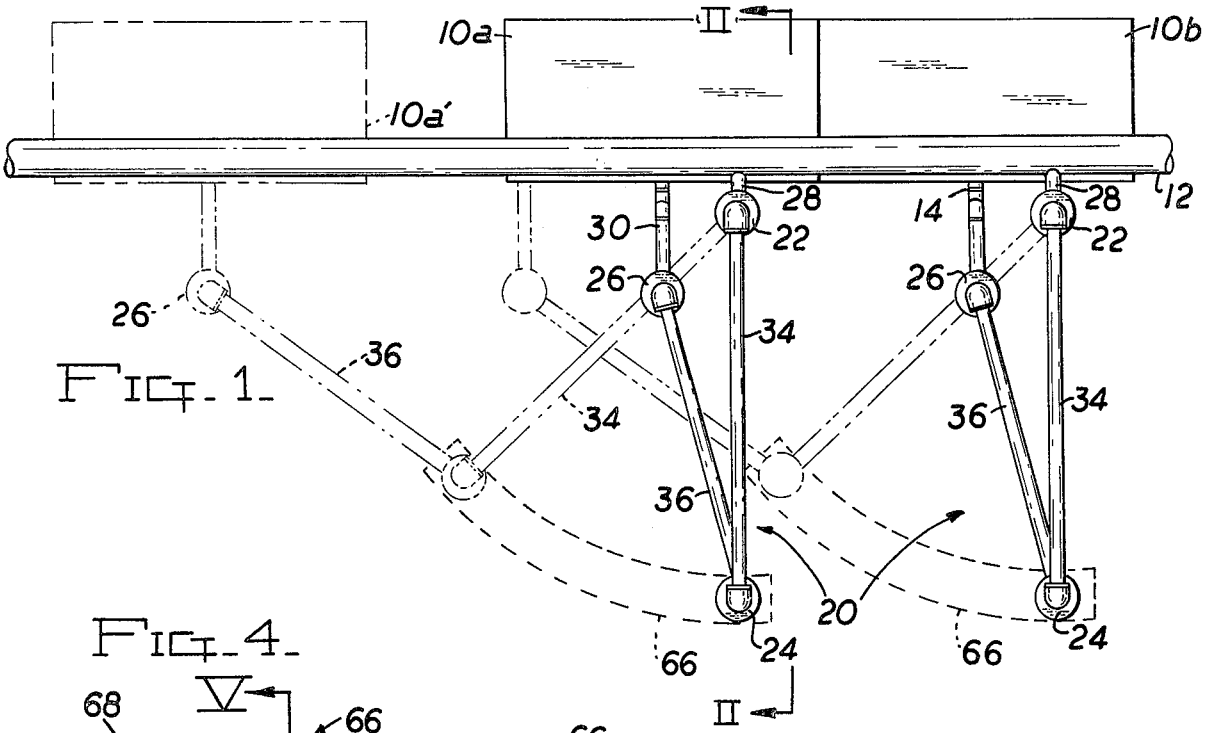
FIG. 1.
FIG. 4.
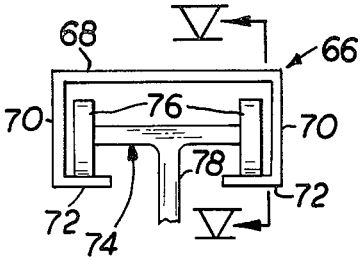
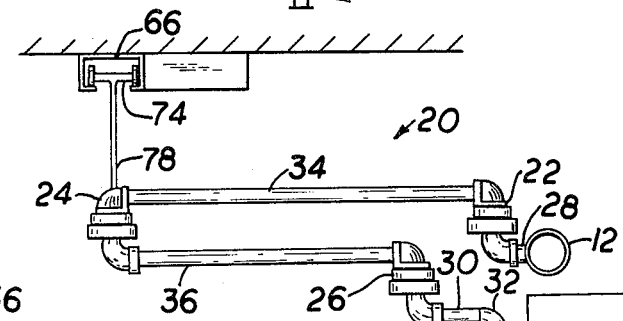
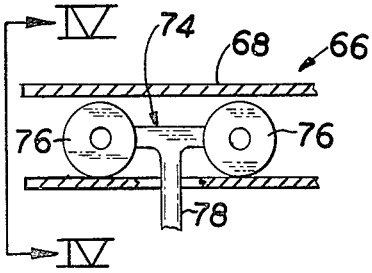
FIG. 5.
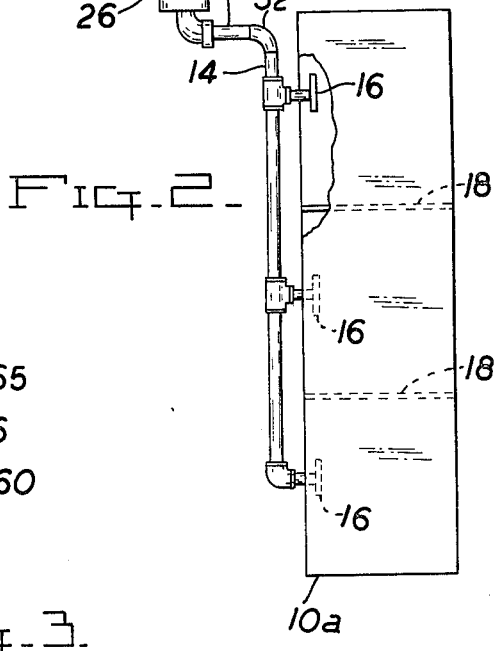
FIG. 2.
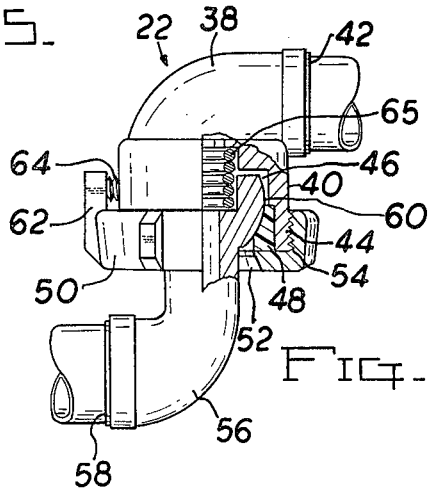
FIG. 3.

FLEXIBLE FIRE PROTECTION SYSTEM

BACKGROUND OF THE INVENTION

In a conventional sprinkler system for fire protection, thermally operated sprinkler nozzles are spaced along a pressurized water main located at an elevated position within the area to be protected. The main and associated sprinkler nozzles are fixed and a sufficient number of mains and nozzles are uniformly spaced above the area to be protected to cover the desired floor space.

In warehouses and other storage areas, it is now known to utilize movable storage cabinets, racks and similar storage members wherein the storage members are mounted upon wheels or tracks as to be horizontally movable with respect to each other eliminating the need for aisle space between adjacent storage members. The use of such movable storage members substantially increases the storage capacity of a given area as compared to conventional systems requiring aisles between adjacent racks.

Under conditions wherein inflammable and dangerous materials are stored upon storage racks, local fire safety codes often require that fire protection sprinkler systems be directly associated with the racks, and be located at each storage level therein. With a fixed storage rack, this fire protection requirement is easily met by plumbing sprinkler nozzles into the racks through fixed distribution conduits communicating with the sprinkler main. However, wherein movable storage racks are employed, difficulty has been experienced in meeting fire protection requirements.

With a movable storage member having a built-in sprinkler system, a flexible conduit system must be employed to permit the member to be moved. If flexible hose is employed to interconnect the sprinkler main with the storage rack distribution conduit, the handling of the hose becomes a problem. Movable storage racks may move twelve or fifteen feet between "closed" and "open" positions, and when the racks are "closed" the excess flexible hose must be accommodated. Further, as flexible hose is not fire resistant to the extent of rigid metal conduits, it does not meet the codes of many localities for sprinkler systems.

It is an object of the invention to provide a flexible conduit system formed of rigid conduits wherein the system may be utilized with movable storage members and permit the members to be freely moved between "closed" and "open" positions without imposing any adverse effects upon the storage member.

A further object of the invention is to provide a flexible rigid conduit system for supplying water to a movable storage member wherein the conduits are interconnected by rotary joints, and the rotary joints are of the self-aligning type and accommodate misalignments and tolerance variations.

Yet another object of the invention is to provide a flexible rigid conduit system utilizing self-aligning rotary joints wherein the portion of the conduit system remote from fixed portions thereof is movably supported by a track and carriage member which does not interfere with the flexing of the system.

In the practice of the invention, a plurality of movable storage racks are displaceable with respect to each other and each includes a built-in sprinkler nozzle system receiving pressurized water from a fixed sprinkler main through a flexible conduit assembly. The flexible conduit assembly includes rotary joints mounted adjacent the sprinkler main and the storage rack distribution conduit, and these rotary joints each communicate with generally horizontally disposed conduits interconnected at a location spaced from the main by a third rotary joint.

The conduits form a flexible elbow joined at a location remote from the fixed portions of the conduit system, and as the rotary joints are preferably of the self-aligning type, an overhead movable support is associated with the third rotary joint to support the same and maintain the conduits in a relatively horizontal orientation. The support consists of a track having a carriage movable therein, and the track does not distract from the free operation and adjustability of the conduit system.

BRIEF DESCRIPTION OF THE DRAWINGS

The aforementioned objects and advantages of the invention will be appreciated from the following description and accompanying drawings wherein:

FIG. 1 is a plan view of a storage rack system utilizing the flexible rigid conduit system of the invention, two storage racks being illustrated in the "closed" condition in full lines, and one of the racks being shown in an "open" position in dotted lines, FIG. 2 is a side elevational view of the conduit and storage rack system, FIG. 3 is an elevational, partially sectioned, view of a self-aligning rotary joint as used with the invention, FIG. 4 is a detail, enlarged, elevational, sectional view, of the track and carriage as taken along Section IV—IV of FIG. 5, and FIG. 5 is a detail, enlarged, elevational, sectional view of the track and carriage as taken along Section V—V of FIG. 4.

DESCRIPTION OF THE PREFERRED EMBODIMENT

As apparent in FIGS. 1 and 2, a plurality of movable storage members, such as storage racks, are shown at 10*a* and 10*b*, and usually several such racks are located together. In FIG. 1, the storage racks are shown in their contiguous "close" relationship in full lines, and the racks are mounted upon tracks and wheels, not shown, as to be movable to the left as viewed in FIG. 1. The displaced "open" position of storage rack 10*a* is illustrated in dotted lines in FIG. 1 as at 10*b*'. When the storage rack is in the 10*a*' position, 10*a* and 10*b* have been sufficiently separated to permit access to the left end of rack 10*b*.

The space in which the storage racks are located is provided with a fire protection system consisting of a plurality of sprinkler mains 12 extending over the area. As flammable materials are stored within the storage racks 10*a* and 10*b*, some codes require that each shelf area of a storage rack contain a sprinkler nozzle, and with the racks disclosed the individual rack sprinkling system includes a distribution conduit 14. A plurality of thermally operated sprinkler nozzles 16 are plumbed to the conduit 14, a nozzle being located within each rack compartment defined by shelves 18.

The flexible rigid conduit system of the invention is generally indicated at 20 and this system includes a plurality of identical rotary joints 22, 24 and 26. The specific construction of the rotary joint is described below.

The rotary joint 22 communicates with the sprinkler main 12 by means of a short conduit 28, and the rotary joint 26 communicates with the distribution conduit 14 through conduit 30 and conventional elbow 32. A relatively long conduit 34 also communicates with the rotary joint 22, and the relatively long conduit 36 communicates with the joint 26. The outer ends of the conduits 34 and 36 communicate with the rotary joint 24, and it will be appreciated that the conduit system 20 establishes fluid communication between the sprinkler main 12 and the storage rack distribution conduit 14.

With reference to FIG. 3, the rotary joints 22, 24 and 26 are identical and each include an upper elbow 38 which is formed with an annular skirt portion 40. The elbow 38 also includes a threaded opening 42 which receives a conduit, and the upper elbow is provided with threads 44 at its lower region. A chamber 46 is defined within the elbow 38 and an annular seal 48 is located within a recess in the skirt 40, this seal ring being formed of Teflon, a trademark of the DuPont Company.

The upper elbow 38 assembly also includes a nut 50 having an opening 52 defined therein and threads 54 formed on the nut cooperate with the threads 44 to attach the nut to the upper elbow 38.

The rotary joints also include a lower elbow 56 which has a threaded opening 58 for receiving a threaded conduit such as at 28 or 36, and the lower elbow 56 includes a spherical sealing surface 60 engaged by the seal ring 48. Thus, it will be appreciated that the components may be assembled as apparent in FIG. 3, and the nut 50 is locked to the upper elbow 38 by means of a boss 62 defined upon the nut receiving set screw 64 which engages and locks against the elbow 38.

A compression spring 65 is interposed between the upper elbow 38 and lower elbow 56 biasing these elbows away from each other which maintains a sealed engagement relationship between the seal ring 48 and the spherical surface 60.

The rotary joints 22, 24 and 26 are self-aligning due to the presence of the spherical surface 60 and the engagement thereof by the seal 48. Thus, the axes of the openings 42 and 58 need not be parallel, as a non-parallel relationship merely causes the seal ring 48 to engage a different portion of the surface 60 without adversely affecting the sealed relationship between elbows 38 and 56. This type of rotary joint has been available from the assignee for a number of years, and rotary joints of a known self-aligning type, other than that illustrated, may be utilized in the concepts of the invention.

As the rotary joints are preferably of the self-aligning type, it is desirable to support the "outer" region of the conduit system 20 at the joint 24 against the effect of gravitational force. For instance, without a support associated with the outer regions of the conduits 34 and 36, the self-aligning features of the joints 22 and 26 would permit the conduits 34 and 36 to "sag" from the preferred substantially horizontal position as illustrated in FIG. 2.

The outboard support of the conduit system may take several forms, and a preferred form is that illustrated wherein an arcuate track 66 is mounted upon the ceiling or a support bracket. The track 66 includes a base 68 from which depend parallel legs 70 terminating in inwardly deformed flanges 72. Lengthwise, the track 66 is of an arcuate form, as shown in dotted lines in FIG. 1, the arc thereof corresponding to the radius having a center at the vertical axis of rotary joint 22.

A carriage 74 is supported within the track 66 by four wheels 76, and in this manner, the carriage 74 freely moves within the track 66. A link 78 affixed to the carriage 74 is attached to the outboard rotary joint 24, FIG. 2, and in this manner sagging of the conduit system 20 is prevented, yet the adjustment and displacement of the conduit system during movement of the storage rack is unimpeded.

In FIG. 1, the "open" positions of the storage racks and associated conduit systems is illustrated in dotted lines. When the storage racks are shifted to an open position, the elbow defined by conduit 34, rotary joint 24 and conduit 36 will define an acute angle, and in the practice of the invention pressurized water will be supplied to the storage racks regardless of their position upon their supporting track. As the conduits 34 and 36 are maintained in a substantially horizontal orientation by the track 66, the conduits cause no storage or handling problems regardless of the position of the associated storage rack, and the system is relatively maintenance free for long periods of time.

It is to be appreciated that the concept of the invention could be utilized in a system wherein the rotary joints and the conduits 34 and 36 are oriented such that the conduits 34 and 36 are substantially vertical, rather than horizontal, and in such an arragement the supporting track 66 would not be required. Such a "vertical" orientation of the conduit system would limit access to one side of the storage rack due to the presence of the conduits 34 and 36, but as in the aforedescribed embodiment, the self-alignment characteristics of the rotary joints will accommodate conduit misalignment and manufacturing tolerances, and it is appreciated that other modifications to the inventive concepts within the scope of one skilled in the art may be apparent.

We claim:

1. A flexible rigid conduit system, particularly suitable for fire protection sprinkler installations on movable storage racks comprising, in combination, a fixed supply conduit, a distribution conduit affixed to a movable storage member, nozzle means mounted upon said member in communication with said distribution conduit, a first rotary joint communicating with said supply conduit, a first conduit communicating with said first joint, a second rotary joint communicating with said distribution conduit, a second conduit communicating with said second joint, and a third rotary joint interconnecting said first and second conduits at a location spaced from said first and second rotary joints, respectively, wherein said first and second conduits and third joint form a flexible elbow, said first and second conduits being generally horizontally disposed, and movable support means supporting said first and second conduits at a location spaced from said first rotary joint supporting said first and second conduits in said generally horizontal orientation.

2. In a flexible rigid conduit system as in claim 1, at least one of said rotary joints being of the self-aligning type whereby misalignments intermediate said supply conduit and distribution conduit will be accommodated.

3. In a flexible rigid conduit system as in claim 1, said support means comprising a fixed track, a carriage movable mounted upon said track and a link effectively interconnecting said carriage to said first and second conduits.

4. In a flexible rigid conduit system as in claim 3, said link being affixed to said third rotary joint.

5. In a flexible rigid conduit system as in claim 4, each of said rotary joints being of the universal self-aligning type.

* * * * *